US005473337A

United States Patent [19]

Berger

[11] Patent Number: 5,473,337

[45] Date of Patent: Dec. 5, 1995

[54] CATALYTIC INITIATOR

[76] Inventor: Bradley I. Berger, 150 E. 18 St., New York, N.Y. 10003

[21] Appl. No.: 183,974

[22] Filed: Jan. 21, 1994

[51] Int. Cl.[6] ..... G09G 3/04

[52] U.S. Cl. ..... 345/34; 40/1.5; 40/1.6; 345/33

[58] Field of Search ..... 63/31, 20; 40/1.5, 40/1.6; 340/573; 345/33, 34, 213, 150

[56] References Cited

U.S. PATENT DOCUMENTS

| | | | |
|---|---|---|---|
| D. 279,910 | 7/1985 | Detro | D20/28 |
| 290,827 | 12/1883 | Wiehl | 40/1.6 |
| 553,708 | 1/1896 | Forehand | 63/20 |
| 566,617 | 8/1896 | Patterson | 40/1.6 |
| 1,426,487 | 8/1922 | Laux | 40/1.6 |
| 2,427,257 | 9/1947 | Campbell | 63/20 |
| 3,056,220 | 10/1962 | Nelson | 40/1.5 |
| 3,839,821 | 10/1974 | Forsman | 40/1.5 |
| 4,184,344 | 1/1980 | Pepin | 40/1.6 |
| 4,215,388 | 7/1980 | Reimann | 362/104 |
| 4,556,932 | 12/1985 | Lehrer et al. | 362/103 |
| 4,637,148 | 1/1987 | Barlow | 40/1.5 |
| 4,698,927 | 10/1987 | Yoshiro | 40/1.6 |
| 4,777,744 | 10/1988 | Barnett | 40/1.6 |
| 4,794,383 | 12/1988 | Havel | 345/150 |
| 4,980,679 | 12/1990 | Klaubert | 345/213 |
| 5,010,665 | 4/1991 | Clinkscales | 40/1.5 |
| 5,138,779 | 8/1992 | Earnest | 40/1.6 |

FOREIGN PATENT DOCUMENTS

| | | | |
|---|---|---|---|
| 2565724 | 12/1985 | France . | |
| 3701321 | 10/1987 | Germany | 340/573 |
| 685000 | 3/1965 | Italy | 63/20 |

*Primary Examiner*—Curtis Kuntz
*Assistant Examiner*—Vivian W. Chang
*Attorney, Agent, or Firm*—Natter & Natter

[57] ABSTRACT

A social encounter catalytic initiator includes an integrated circuit counter and a display driver which drives a seven segment display. The counter and driver are carried within a housing along with the display and the housing may be in the form of a sign, badge or pin. The counter is incrementally actuated by a user to provide, at the display, a visual measure of the user's interest in establishing a social relationship with another person who is in view. The display may be driven to provide numeric, alphabetic or word format incremental values. A comparator may be employed for switching the color of the display when the user selected incremental value exceeds a variable predetermined color change incremental value.

9 Claims, 2 Drawing Sheets

FIG. 1
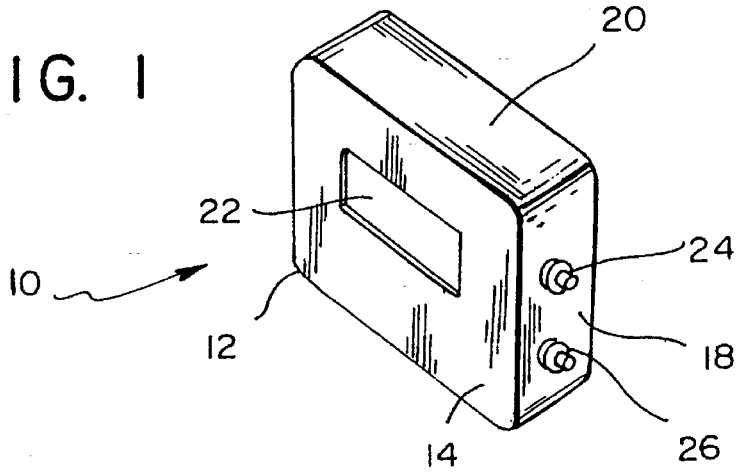
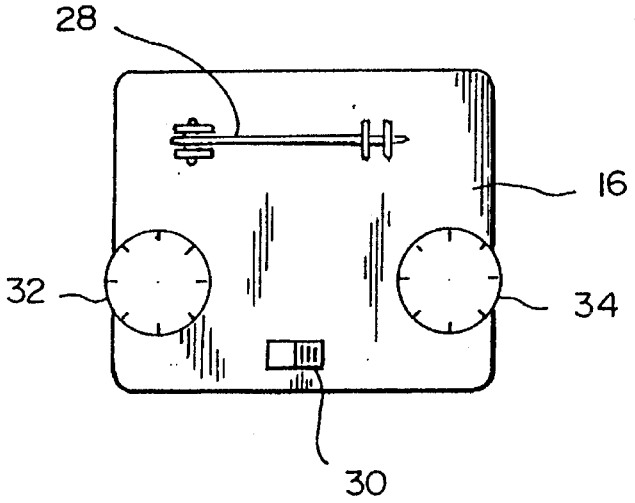
FIG. 2
FIG. 3
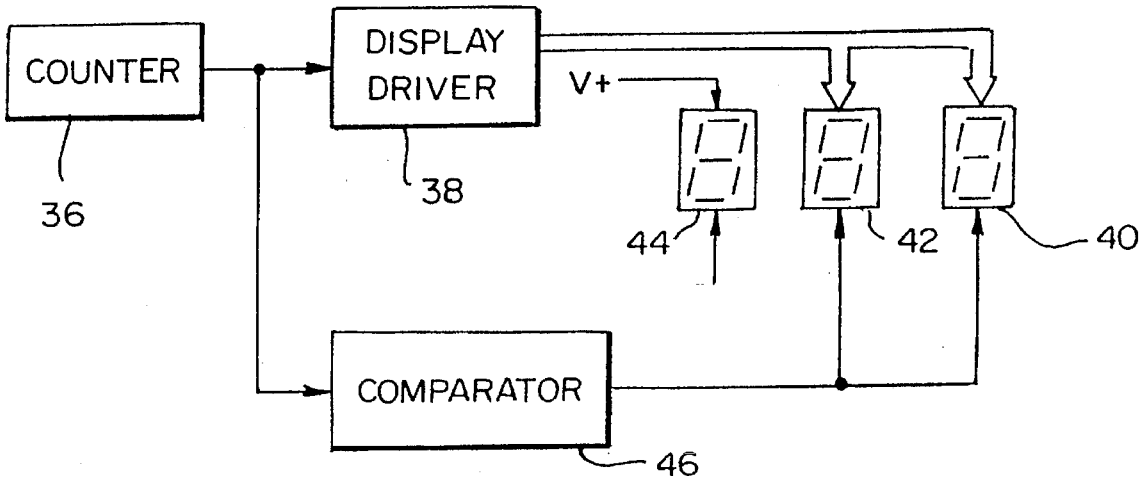

58
62
64
68
60
34
38
45
66
46
24
52
54
56
48
50
26
30
32
36
V+
B+
BI
A
B
C
D
LT
LE
a
b
c
d
e
f
g
B0
B1
B2
B3
A0
A1
A2
A3
P0
P1
P2
P3
Q0
Q1
Q2
Q3
LOAD
CLOCK

CATALYTIC INITIATOR

BACKGROUND OF THE INVENTION

1. Field of the Invention

This invention relates generally to establishing social relationships and more particularly to an initiator for apprising a potential social companion of one's interest in pursuing an encounter.

2. Related History

Often, at various social occasions, awkward situations have developed when a person has attempted to initiate a social relationship by engaging in conversation while the intended participant had no interest in pursuing any relationship. Additionally, shy people were inhibited from approaching another person for embarrassment and fear of rejection.

A need therefore developed for providing a preconversation visual indication of a prospective conversant's interest in talking with or establishing a relationship with another person. The provision of a visual indicator of an intended recipient's desire to engage in social conversation and/or establish a transitory or permanent social relationship with another would render initiation of an initial encounter less awkward, and would especially provide a shy or inhibited person an inclination to proceed, knowing in advance, the intended participant's favorable initial reaction.

In U.S. Pat. No. 4,184,344, a mood indicating pendant in the form of a miniature traffic light was disclosed. The pendant was wearer actuatable to display either a red, yellow or green traffic signal as an indication of the wearer's mood. Among the attributes of the pendant disclosed in the patent was that by providing an outward indication of the mood of the user, endless hours of polite sparring and discussion would be saved, and thus, use of the pendant would result in energy conservation.

The traffic light pendant did not gain widespread acceptance, or for that matter, little is known as to whether or not it was ever commercialized. Among the inherent disadvantages of the traffic light pendant was that it provided only three indicia signals and no intermediate comparative levels reflecting the mood or inclination of the wearer were available. Additionally, the device was not easily resettable and required manual manipulation. Further, and especially for shy individuals, the wearing of a traffic light may have provided a source of embarrassment and thus a deterrent to usage.

SUMMARY OF THE INVENTION

A catalytic initiator for facilitating social encounters includes a sign, badge or pin having a display which is user actuated to incrementally indicate, by numeric, alphabetic or other graduated visual format, a measure of the user's interest in approaching and engaging in social conversation or other social activities with another person. The initiator may include a seven segment display, an incrementable integrated circuit counter and a display driver. A comparator may also be employed for switching the color of the display after a user selected increment value has been reached. Additionally, a user selected initial count or increment value may be provided each time the counter is reset.

From the foregoing compendium, it should be appreciated that it is an aspect of the present invention to provide a catalytic initiator which provides a feasible solution to and overcomes the problems of the related history aforementioned.

A feature of the present invention is to provide a catalytic initiator of the general character described which promotes social conversation by providing a visual indication of an intended participant's receptivity.

It is a consideration of the present invention to provide a catalytic initiator of the general character described which includes an incremental display for providing a visual measure of an intended participant's receptivity in pursuing a social encounter.

Another aspect of the present invention is to provide a catalytic initiator of the general character described which serves to facilitate the initiation of social discourse.

An additional feature of the present invention is to provide a catalytic initiator of the general character described wherein incrementable visual indicia of the receptivity of an intended partner to a social encounter may be sequentially displayed.

A further consideration of the present invention is to provide a catalytic initiator of the general character described wherein an incremented visual indication of the receptivity of an intended participant to a social encounter will change in color with increasing increment values.

To provide a catalytic initiator of the general character described which is light in weight and may consequently be worn as a pin is yet a further aspect of the present invention.

A still further feature of the present invention is to provide a catalytic initiator of the general character described which promotes relaxed conversation by providing an incremented visual indication of a prospective conversant's receptivity to conversation.

To furnish a catalytic initiator of the general character described which is relatively low in cost is a still further feature of the present invention.

Another consideration of the present invention is to provide a catalytic initiator of the general character described which is susceptible to manufacture by mass production fabrication techniques through implementation of integrated circuits.

Other aspects, features and considerations of the present invention in part will be obvious and in part will be pointed out hereinafter.

With these ends in view, the invention finds embodiment in certain combinations of elements, arrangements of parts and series of steps by which the said aspects, features and considerations are attained, all with reference to the accompanying drawings and the scope of which will be more particularly pointed out and indicated in the appended claims.

BRIEF DESCRIPTION OF THE DRAWINGS

In the accompanying drawings in which is shown one of the various possible exemplary embodiments of the invention, FIG. 1 is a perspective illustration of a catalytic initiator constructed in accordance with and embodying the invention and showing a housing having a display panel on the front face thereof and a count increment push button exposed through on a side panel;

FIG. 2 is a rear elevational view thereof and showing a mounting pin finding and two user settable rotary switches, one for presetting a start increment value and the other for presetting a display color changed increment value;

FIG. 3 is a schematized block diagram illustrating the principal components of the catalytic initiator.

DESCRIPTION OF THE PREFERRED EMBODIMENT

Figure 4:
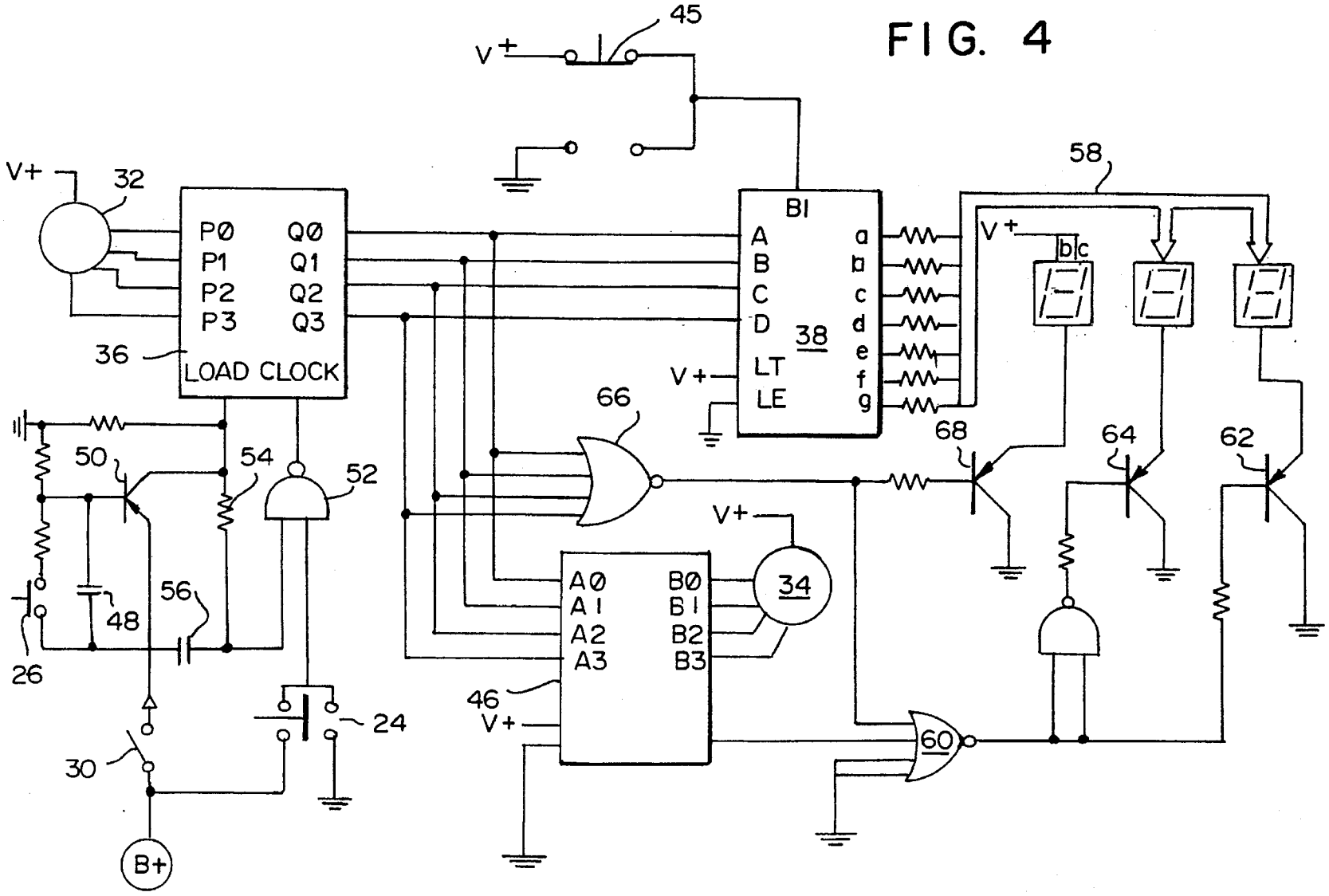
FIG. 4 is a circuit diagram of a typical circuit which may be used in conjunction with the catalytic initiator.

Referring now in detail to the drawings, the reference numeral 10 denotes generally a catalytic initiator constructed in accordance with and embodying the invention. The initiator includes a housing or case 12 having a substantially rectangular front panel 14 and rear panel 16 which are positioned parallel to one another. The housing 12 also includes a pair of parallel side panels 18 and a pair of parallel top and bottom panels 20.

In accordance with the invention, the front panel 14 includes a display window 22 behind which are positioned a plurality of conventional seven segment displays. The initiator 10 also includes a count increment push button 24 and a push button reset switch 26, both of which are accessed through one of the side panels 18.

The rear panel 16 includes a pin finding 28 which may be employed to attach the catalytic initiator 10 to an article of clothing, or the like, if the initiator is to be worn as a badge or pin. Accessible through the rear panel 16 is a power on-off slide switch 30 and a pair of rotary set switches 32, 34. In accordance with the invention, the rotary switch 32 is employed to set a starting value to be displayed a the window 22 and the switch 34 is employed to set an increment count value at which the display appearing at the window 22 changes color.

Referring now in detail to FIG. 3 which comprises a simplified block diagram of the major components of the catalytic initiator in accordance with the invention, it will be seen that there is included a counter 36, preferably in the form of an integrated circuit, with the counter 36 being incremented by the push button switch 24, and reset by the push button switch 26 and with the initial count value, appearing each time the counter is reset, being established by the position of the start value switch 32. The counter output is fed to an integrated circuit display driver 38 whose outputs are applied to a red, amber or yellow seven segment display 40 and to a green seven segment display 42. A further green display 44 receives a continuous signal for illustration of the numeric value "1".

Actuation of the displays 40, 42 is under the control of a comparator 46 which compares the counter output value with the value set by the color change increment value switch 34. If the counter output value is less than the preset value, the comparator output serves to disable the display 42 so that the display driver 38 only actuates the red, amber or yellow display 40. Once the counter output increment value has reached or exceeds the color change increment value established by the switch 34, the comparator output disables the display 40 and enables the display 42.

With the general principles of operation of the catalytic initiator thus described, actual operation of a typical embodiment in accordance with the circuit depicted in FIG. 4 will now become more readily apparent to those of skill in the art.

Referring now to FIG. 4, the counter 36 may be preset with an initial count value. The initial count value is determined by the position of the start value switch 32. The output of the switch 32 appears on a plurality of input lines of the counter and are transferred to four output lines of the counter 36.

The counter will subsequently increment the signals appearing on its output lines under control of signals appearing on its LOAD and CLOCK inputs. The signals appearing on the LOAD and CLOCK inputs of the counter 36 controlled by the count increment push button switch 24 and the reset switch 26.

Upon initially closing the power on switch 30, current flows from a battery supply to charge a capacitor 48 which, eventually forward biases a transistor 50, placing a high signal at the LOAD input of the counter 36. The counter output is incremented by depressing the push button switch 24 which generates a low signal on an input of a Schmitt Trigger NAND gate 52 to generate a rising edge at the CLOCK input of the counter 36.

If the user wishes to reset the counter to the predetermined initial start value, the reset switch 26 is depressed which reduces the bias at the base of the transistor 50, thus changing the signal appearing on the LOAD input of the counter 36 to a low value. Current flows, however, through a resistor 54 to charge a capacitor 56 at a second input of the Schmitt Trigger NAND gate 52. As a result, a short time delay from a low level at the LOAD input of the counter to a low level at the input of the Schmitt Trigger 52 generates a clock pulse of the proper duration at the CLOCK input of the counter to effect resetting.

Outputs of the counter 36 appear at inputs of the decoder/display driver 38. A bus 58 is employed to interconnect the outputs of the display driver 38 with the individual displays 40 and 42. The outputs of the display driver 38 may be blanked, if desired, by actuating a blanking switch 45.

It should be additionally noted that the outputs of the counter 36 also appear at inputs of the comparator 46 which compares the counter value with the increment value preselected by the position of the color change increment value switch 34. When the counter output is equal to or greater than the preselected color change value, a high output signal is generated by the comparator 46. The comparator output signal is received at a NOR gate 60. When the counter output is below the value preset by the switch 34, the output of the NOR gate 60 is high and serves to forward bias a transistor 62 which facilitates actuation of the red, orange or yellow display 40. The cathodes of the remaining displays, 42 and 44 are not connected to ground and will not be activated.

When the predetermined color change increment value has been reached, a high comparator output signal switches the output of the NOR gate 60 low, the transistor 62 will be switched off and a transistor 64 will be forward biased so that the green display 42 will be actuated and the incremented value will appear on such display. The value incremented through the numeral 9 will appear on the display 42. To indicate the numeral 10, however, the output of the counter 36 is, in actuality, 0 and all of the signals appearing at the counter output will be low.

The counter output signals also appear at a further NOR gate 66 and when all of its inputs are low, the gate 66 generates a high output signal which biases a transistor 68 to interconnect the cathode of the display 44 with ground. The inputs of the display 44 are connected to generate a visual indication of the numeral 1. The output of the NOR gate 66 also appears as an input to the NOR gate 60 to cause the gate 60 to generate a low output signal to assure that the display 40 remains deactivated although the output of the comparator, i.e. 0, is less than the predetermined color change value as determined at the switch 32.

By way of example only and not limitation, the counter 36 may comprise a 74HC160 presettable BCD counter, the decoder/display driver 38 may comprise a 74HC4511 BCD to seven segment driver, the comparator 46 may comprise a 74HC85 4 bit magnitude comparator, the Schmitt Trigger NAND gate 52 may comprise a 74HC132 quad two input NAND Schmitt Trigger and the NOR gates 60, 66 may comprise segments of a 74HC4002 from input NOR gate.

Although by way of example, the foregoing description illustrates numeric incremental values, the counter and driver may be configured to drive the displays with alphabetic incremental values, or incremented word message values, all within the ambit of the invention.

Having thus described the invention, it will be seen that there is provided a catalytic initiator which achieves the various aspects, features and considerations of the present invention and which is well adapted to meet the conditions of practical usage.

As various changes might be made in the exemplary embodiment above set forth without departing from the spirit of the invention, it is to be understood that all matter herein described or illustrated in the accompanied drawings is to be interpreted as illustrative and not in a limiting sense.

Having thus described the invention, there is described as new and desired to be secured by Letters Patent:

1. A catalytic initiator for providing a visual indication of a user's interest in establishing a social relationship with a person who is in view, the initiator comprising visual display means for indicating an incremental numeric value representative of the user's interest in establishing a social relationship with the person, sequentially actuatable electrical switch means for user selection of the incremental numeric value, means for driving the visual display means, means interconnecting the sequentially actuatable switch means and the means for driving, the means for driving including means for providing a signal indicative of the instantaneous sequentially actuated incremental numeric value, the display means receiving the signal and in response thereto visually indicating the instantaneous incremental numeric value and means for changing the color in which incremental numeric values are displayed, the means for changing the color in which the incremental numeric values are displayed including means for determining whether the instantaneous numeric value equals or exceeds a predetermined numeric value and for changing the color of the displayed incremental value when the instantaneous numeric value equals or exceeds the predetermined numeric value, whereby the user continues sequential actuation of the switch means until the desired incremental numeric value is displayed.

2. A catalytic initiator for providing a visual indication of a user's interest in establishing a social relationship as constructed in accordance with claim 1 further including means for attaching the catalytic initiator to an article of clothing worn by the user.

3. A catalytic initiator for providing a visual indication of a user's interest in establishing a social relationship as constructed in accordance with claim 1 further including user actuatable switch means for selecting the predetermined numeric value.

4. A catalytic initiator for social interaction between a first person and a second person, the initiator comprising at least one seven segment display means for visually displaying an incremental numeric value indicative of the first person's desire to engage in social interaction with the second person, means for driving the seven segment display means, means for incrementing the driving means with sequential numeric values, and means for changing color of the numeric value displayed upon incrementing beyond a predetermined numeric value, the means for incrementing including a push button switch operable by the first person.

5. A catalytic initiator for social interaction as constructed in accordance with claim 4 further including a plurality of seven segment displays.

6. A method of catalytically initiating the establishment of a social relationship between a first person and a second person, the method comprising the steps of:

a) providing an electrically driven display capable of color change, b) actuating the display to sequentially present incrementally increasing numeric values in a first color, c) changing the display to a second color when the incremented numeric value equals or exceeds a predetermined value;

d) discontinuing the incrementing of displayed numeric values when the incremented numeric value comprises a selected numeric value indication of the first person's interest in engaging in social interaction with the second person; and e) maintaining actuation of the display at the selected numeric value.

7. A method of catalytically initiating the establishment of a social relationship between a first person and a second person in accordance with claim 6 further including the step of:

f) selecting the predetermined value for changing the display to the second color.

8. A method of catalytically initiating the establishment of a social relationship between a first person and a second person in accordance with claim 6 further including the step of:

f) attaching the display to an article of clothing worn by the first person.

9. A method of catalytically initiating the establishment of a social relationship between a first person and a second person in accordance with claim 6 further including the step of:

f) providing at least two electrically driven displays.

* * * * *